United States Patent [19]

Jacob et al.

[11] Patent Number: 5,054,474

[45] Date of Patent: Oct. 8, 1991

[54] WATER MASSAGE APPARATUS

[76] Inventors: Greg Jacob, 9588 Everglades Park La., Boca Raton, Fla. 33428; Joseph Outhyse, 6086 NW. 74th Terr., Parkland, Fla. 33067

[21] Appl. No.: 342,873

[22] Filed: May 17, 1989

Related U.S. Application Data

[63] Continuation-in-part of Ser. No. 252,935, Oct. 4, 1988, abandoned.

[51] Int. Cl.[5] ..... A61H 9/00

[52] U.S. Cl. ..... 128/66; 128/64

[58] Field of Search ..... 128/66, 366, 64; 239/381, 383, 258, 601, 615, 617, 278, 378, 581.1, 381, 588; 251/208, 304; 137/624.31; 285/396, 401, 402

[56] References Cited

U.S. PATENT DOCUMENTS

| | | | |
|---|---|---|---|
| 7,318 | 4/1850 | Brown | 285/396 |
| 20,488 | 8/1937 | Zimkil | 239/428.5 |
| 174,781 | 3/1876 | Clements | 239/428.5 |
| 385,069 | 6/1988 | Richardson | 239/581.1 |
| 437,915 | 10/1890 | Costigan | 285/401 |
| 578,948 | 3/1897 | Schaffstaett | 239/428.5 |
| 948,421 | 2/1910 | Hax | 239/428.5 |
| 2,954,936 | 10/1960 | Shames et al. | 239/428.5 |
| 3,138,153 | 6/1964 | Osborn et al. | 128/66 |
| 3,340,870 | 9/1967 | Steltz et al. | 128/66 |
| 3,396,722 | 8/1968 | Lindberg | 128/66 |
| 3,412,939 | 11/1968 | Shaffer | 239/581.1 |
| 3,801,019 | 9/1974 | Trenary et al. | 239/381 |
| 3,868,949 | 3/1975 | Arneson | 128/66 |
| 3,910,554 | 10/1975 | Speedie | 251/208 |
| 4,019,535 | 4/1977 | Back et al. | 251/304 |
| 4,145,004 | 3/1979 | Krizik | 239/581.1 |
| 4,204,646 | 5/1980 | Shames et al. | 239/381 |
| 4,221,337 | 9/1980 | Shames et al. | 239/428.5 |
| 4,221,338 | 9/1980 | Shames et al. | 239/428.5 |
| 4,477,109 | 10/1984 | Kleuver | 285/396 |
| 4,588,131 | 5/1986 | Yamamoto et al. | 239/428.5 |
| 4,593,420 | 6/1986 | Tobias et al. | 4/541 |
| 4,637,080 | 1/1987 | Hutchinson | 4/542 |
| 4,758,023 | 7/1988 | Vermillion | 285/401 |
| 4,793,331 | 12/1988 | Stewart | 128/66 |
| 4,805,664 | 2/1989 | Matter et al. | 4/542 |
| 4,926,510 | 5/1990 | Watkins | 4/542 |

FOREIGN PATENT DOCUMENTS

| | | | |
|---|---|---|---|
| 0312591 | 12/1988 | Japan | 251/304 |

*Primary Examiner*—Edgar S. Burr
*Assistant Examiner*—Lisa E. Malvaso
*Attorney, Agent, or Firm*—Alfred D. Lobo

[57] ABSTRACT

A water massage apparatus is provided for use in a spa which is provided with at least one inlet port through which is flowed an aerated jet of water under pressure. The conventionally provided casing or annular locking ring used to couple a conventional water jet device, is replaced with a hollow bushing which couples an aspirating adapter to a recessed receptacle in the interior wall of the spa. The adapter is connected to a head by a flexible plastic hose, the head being provided with apertures through which aerated water is flowed. The head is provided with a pendant finger which provides a valve means for selectively placing the apertures in the head in open flow communication with the jet of water exiting the receptacle in the spa's wall.

11 Claims, 4 Drawing Sheets

WATER MASSAGE APPARATUS

BACKGROUND OF THE INVENTION

This application is a continuation-in-part of my application Ser. No. 252,935, filed Oct. 4, 1988, abandoned Mar. 14, 1990.

The present invention is directed to the field of water sprayers, and is more specifically directed to water massage apparatus which can be hand-held, for use with portable spas, in-ground spas, pool spas or the like having an interior wall including at least one receptacle into which a water jet, the term used to identify the nozzle through which a mixture of water and air is jetted, can be selectively inserted.

In all spas which employ water jets, each water jet is surrounded by a casing the term used to identify the unitary assembly of separate water and air intakes through which water and air are flowed and mixed before aerated water issues from the water jet, which is received in a receptacle recessed in the spa's interior wall. However, in a pool spa or an in-ground spa, the jets are flush with the wall, and the casing extends out of the wall and is externally threaded to mate with an internally-threaded open-ended cap to provide a smooth surface at the spa wall. In a portable (above-ground) spa, the jets and casing are recessed into ports in the surface of the wall of the spa and each casing is externally threaded for mating engagement with an internally-threaded receptacle at the base of each recess. Thus, different mechanisms are required for a device such as water massage apparatus to be connected to the water jet receptacles of an in-ground or pool spa, on the one hand, and a portable spa on the other hand.

Most hand-held water sprayers are adapted to be used in place of a conventional shower head in a bathtub. Such sprayers are characterized by West German Patent No. 2,028,937 to Weller, West German Patent No. 2,200,675 to Westerhoff, West German Patent No. 2,830,201 to Berenbrinker, West German Patent No. 3,506,078 to Haft, and Great Britain Patent No. 769,885 to Grohe. No mechanism is provided whereby such sprayers can be adapted for connection with the water jet receptacles of pool and in-ground spas or portable spas, much less all three. Also, since the flow of water to these sprayers is controlled by the bathtub faucets, these sprayers are not provided with separate on/off mechanisms Moreover, these sprayers are provided with jet plates or similar mechanisms designed to increase the pressure of the water as it exits the sprayer, thereby creating a massaging effect. Such an increase in pressure is unnecessary in a spa, as the water exiting the water jets is already under sufficiently high pressure to create a massaging effect.

Because of the high pressure of the water exiting the water jets, it is necessary that the interior structure of any massage device connected to a spa jet be sturdy enough to withstand such pressure. Further, because all the water jets of a spa are operated by a single on/off mechanism, it is necessary that any massage device connected to a spa jet have its own separate on/off mechanism if the spa is to be used without operating the massage device. It is the solution of these and other problems to which the present invention is directed.

SUMMARY OF THE INVENTION

Therefore, it is the primary object of this invention to provide a water massage apparatus for use in a spa or the like wherein the spa water jet can be used as the water source.

It is another object of this invention to provide a water massage apparatus in which the water pressure as it exits the head of the apparatus is substantially the same as when it enters.

It is another object of this invention to provide a water massage apparatus having a minimum number of moving parts.

It is still another object of this invention to provide a water massage apparatus which can be used in any spa, regardless of the positioning of the jets.

It is still another object of this invention to provide a water massage apparatus which can be turned on and off separately from the water source.

These and other objects of the invention are achieved by the provision of a water massage apparatus comprising a head having an inlet port and outlet apertures, a hollow adapter dimensioned to register with the casing surrounding the water jet, and a hollow replacement casing selectively engageable with the receptacle in the spa wall for replacing the casing which normally surrounds the water jet, and dimensioned to receive the proximal end of the water jet therewithin. Plain plastic tubing or a conventional pool or garden hose is attached at one end to the head and at the other end to the adapter.

The head comprises a base and a cap rotatably attached to the base. The base comprises a side wall having inner and outer surfaces and an upper rim, an open top defined by the upper rim of the side wall, and a lower wall defining a closed bottom and having inner and outer surfaces. The side wall has an inlet aperture therethrough and a substantially circular lateral cross-section. An inlet port extends outwardly from the outer surface of the side wall at the inlet aperture and includes a connector for selectively connecting the head to one end of the tubing or hose.

The cap is rotatably attached to the base and comprises a side wall having inner and outer surfaces and a lower rim, and an upper wall defining a closed top and having inner and outer surfaces. The side wall has a substantially circular lateral cross-section. The lower rim defines an open bottom and sealingly engages the upper rim of the base. The upper wall of the cap includes a plurality of evenly spaced-apart radial outlet apertures therein. A finger extends vertically downwardly from the lower rim of the cap and has inner and outer surfaces, the inner surface being coextensive with the inner surface of the side wall of the cap and the outer surface of the finger sealingly engaging the inner surface of the side wall of the base, the finger being dimensioned to cover the inlet aperture and defining a valve for opening and closing the inlet aperture.

In one aspect of the invention, the sum of the lateral cross-sections of the outlet apertures is approximately equal to the area of the lateral cross-section of the inlet aperture.

In another aspect of the invention, the inner and outer surfaces of the upper wall of the cap are substantially frusto-conical.

In yet another aspect of the invention, the inlet port of the base and one end of the adapter are externally barbed to selectively engage the ends of the tubing or threaded to selectively engage the ends of the hose.

In still another aspect of the invention, the exterior of the replacement casing is threaded at one end to selectively engage the internal threads of both a spa jet receptacle.

In another aspect of the invention, the replacement casing and the adapter are connected to each other by connector members integral with the replacement casing and the adapter.

In still another aspect of the invention, a separate connector member is provided to connect the replacement casing to the adapter.

A better understanding of the disclosed embodiments of the invention will be achieved when the accompanying detailed description is considered in conjunction with the appended drawings, in which like reference numerals are used for the same parts as illustrated in the different figures.

DESCRIPTION OF THE PREFERRED EMBODIMENTS

Figure 1:
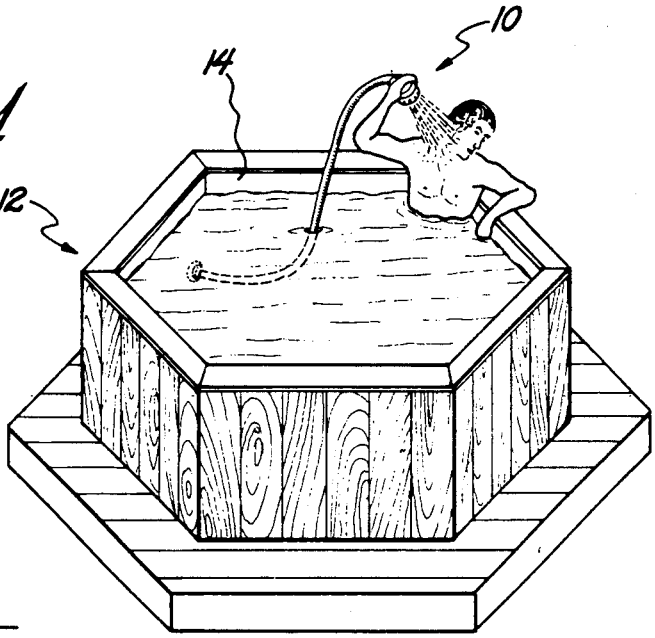
FIG. 1 is a side perspective view of the water massage apparatus according to the invention in use in a spa.
Figure 2:
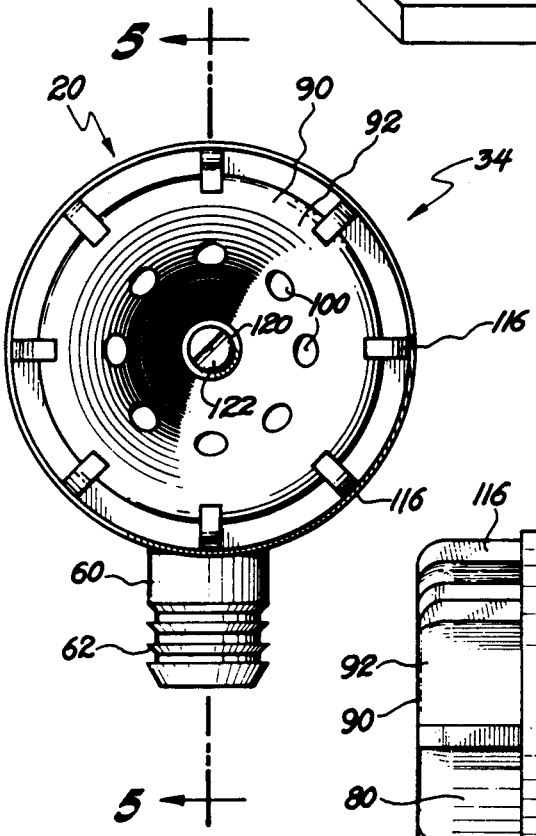
FIG. 2 is a top plan view of the water massage apparatus according to the invention.
Figure 3:
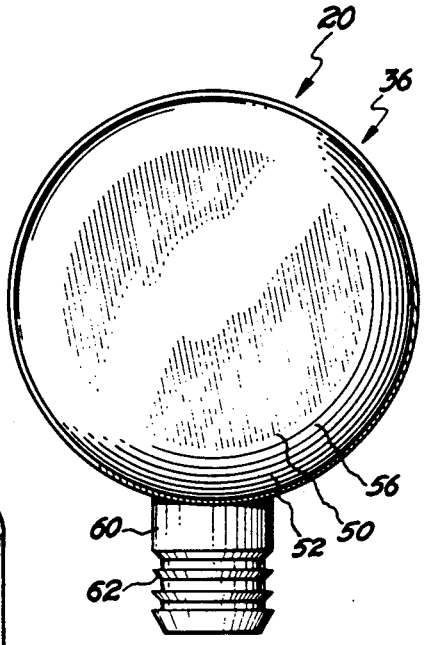
FIG. 3 is a bottom plan view of the water massage apparatus of FIG. 2.
Figure 4:
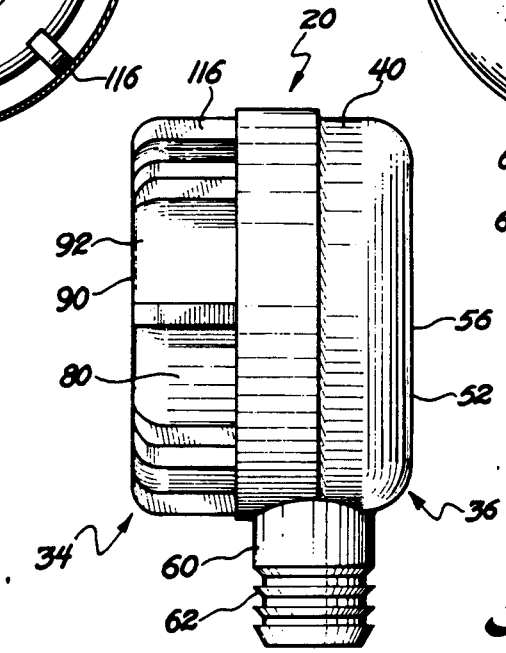
FIG. 4 is a side elevational view of the water massage apparatus of FIG. 2.
Figure 5:
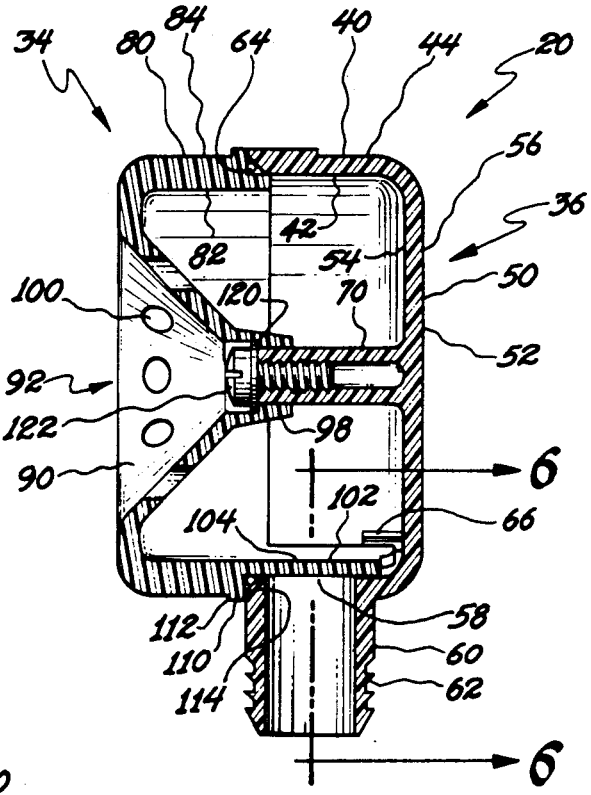
FIG. 5 is a cross-sectional view of the water massage apparatus of FIG. 2, taken along line 5—5 of FIG. 2.
Figure 6:
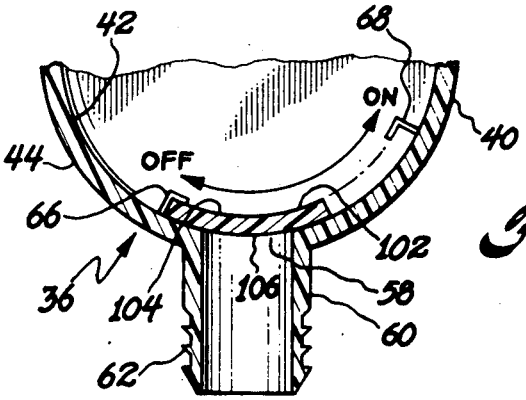
FIG. 6 is a partial cross-sectional view of the water massage apparatus of FIG. 2, taken along line 6—6 of FIG. 5.
Figure 7:
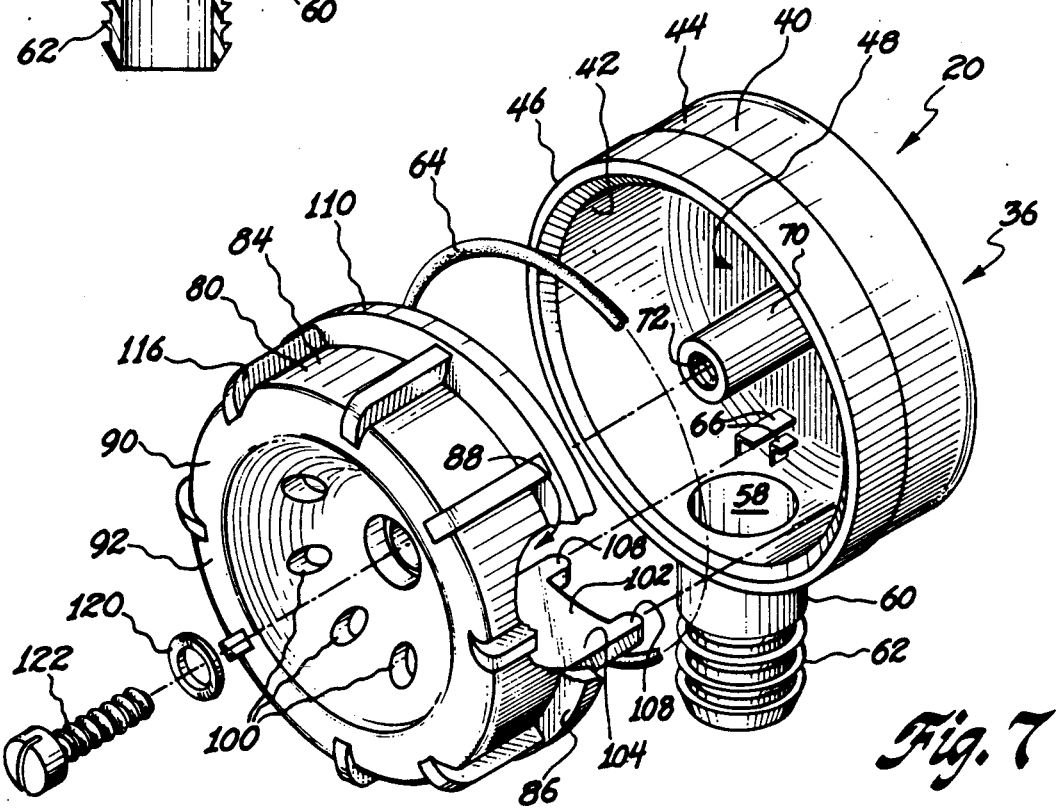
FIG. 7 is an exploded perspective view of the water massage apparatus of FIG. 2.
Figure 12:
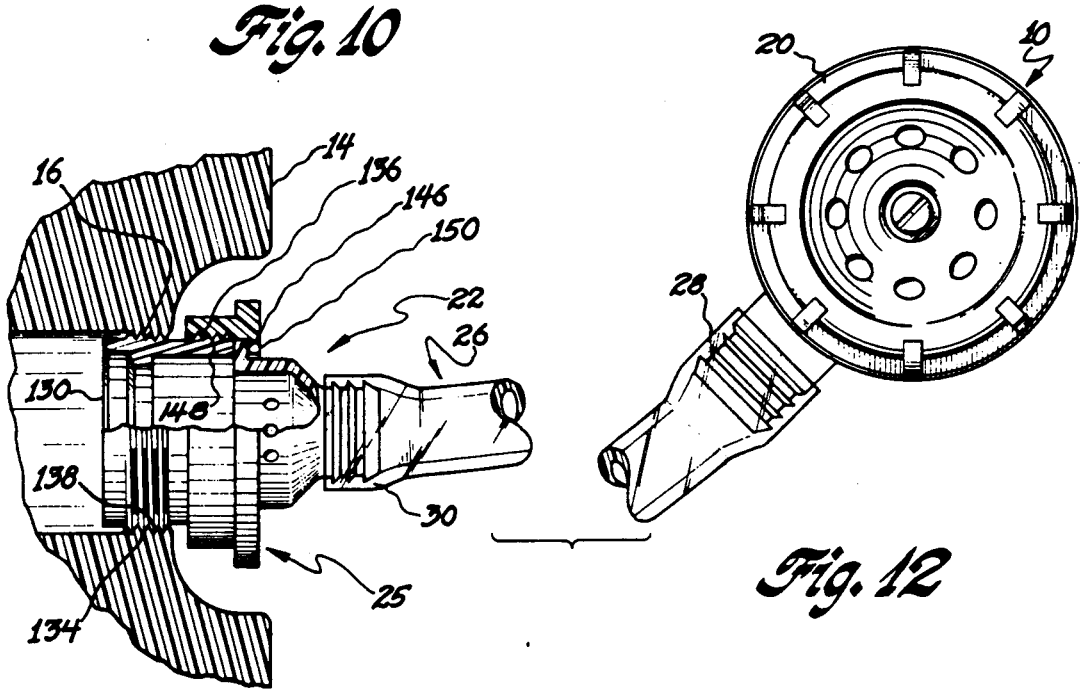
FIG. 12 is a top plan view with parts broken away of the water massage apparatus of the invention installed in a water jet receptacle of the spa shown in FIG. 1, using the adapter and the casing of FIGS. 8 and 10.

Referring now to FIGS. 1 and 12, there is shown a first embodiment of a water massage apparatus 10 according to the invention, in use in a portable spa 12 having an interior wall 14 with a threaded receptacle 16 for receiving a threaded water jet casing (not shown). Water massage apparatus 10 comprises a head 20, a hollow replacement casing 24 selectively insertable into the receptacle 16 in place of the original spa casing, and a hollow adapter 22 dimensioned to register with the replacement casing 24. A conventional hollow connector 25 connects replacement casing 24 to adapter 22. A plain plastic tube 26 having ends 28 and 30 is attached at one end 28 to head 20 and at the other end 30 to adapter 22.

Referring now to FIGS. 2–4 and 12, head 20 comprises a cylindrical cap 34 rotatably disposed upon a base 36. Base 36 comprises a side wall 40 having inner and outer surfaces 42 and 44, an upper rim 46, an open top 48 defined by upper rim 46, and a lower wall 50 defining a closed bottom 52 and having inner and outer surfaces 54 and 56. Side wall 40 has an inlet aperture 58 therethrough and a substantially circular lateral cross-section. An inlet port 60 extends outwardly from outer surface 56 at inlet aperture 58, and includes external annular threads or barbs 62 for selectively connecting head 20 to end 28 of tubing 26.

The inner diameters to inlet aperture 58 and inlet port 60 are $\frac{7}{8}$ inch (2.22 cm) each while the inner diameter of tubing 26 is $\frac{3}{4}$ inch (1.91 cm.), in order to ensure proper flow-through of water through tubing 26 and inlet aperture 58 without any change in the water pressure, and in order to allow a force fit of tubing 26 over barbs 62.

Also, if a conventional pool or garden hose having female threaded ends is to be used, inlet port 60 can be provided with external threads for selective mating engagement with one of the hose ends, as shown in my copending application Ser. No. 252,935, which is specifically incorporated herein by reference.

Upper rim 46 of base 36 is planar adjacent outer surface 44 of side wall 40 and is angled inwardly adjacent inner surface 42 of side wall 40 to receive an O-ring 64. Base 36 also includes a first set of L-shaped locking posts 66 extending upwardly from inner surface 54 of bottom wall 50 adjacent one side of aperture 58, and a second set of L-shaped locking posts 68 extending upwardly from inner surface 54 of bottom wall 50 offset from the other side of aperture 58. A tubular mounting post 70 having internal threads 72 extends upwardly from the center of inner surface 54 of lower wall 50, for a purpose to be described hereinafter.

Cap 34 comprises a side wall 80 having inner and outer surfaces 82 and 84, a lower rim 86, an open bottom 88 defined by lower rim 86, and an upper wall 90 defining a closed top 92 and having inner and outer surfaces 94 and 96. Side wall 80 has a substantially circular lateral cross-section. Inner and outer surfaces 94 and 96 are rounded adjacent side wall 80 and are substantially frusto-conical inwardly of side wall 80. A tubular extension 98 extends inwardly from the center of upper wall 90 for a purpose to be described hereinafter. Upper wall 90 also includes a plurality of evenly spaced-apart radial outlet apertures 100 therein. Outlet apertures 100 are circular in shape, and are formed by drilling through upper wall 90 with a circular bit. In the embodiment shown, there are eight apertures, although the number can be varied.

In order for the pressure of the water exiting head 20 to be substantially the same as the pressure of the water entering head 20, the sum of the areas of outlet apertures 100 is substantially the same as the lateral cross-sectional area of inlet aperture 58. The frusto-conical configuration of top wall 90 directs water out of outlet apertures 100 in a concentrated flow.

A finger 102 extends vertically downwardly from lower rim 86 of cap 34. Finger 102 has inner and outer surfaces 104 and 106, inner surface 104 being coextensive with inner surface 82 of side wall 80 and outer surface 106 sealingly engaging inner surface 42 of side wall 40 of base 36. Legs 108 extend downwardly from either side of finger 102. Finger 102 is dimensioned to cover aperture 58 and defines a valve for opening and closing aperture 58.

Cap 34 also includes a flange 110 extending outwardly from outer surface 84 offset from lower rim 86. Flange 110 has upper and lower surfaces 112 and 114. Lower surface 114 registers with upper rim 46, while outer surface 84 of side wall 80 of cap 34 sealingly engages inner surface 42 of side wall 40 of base 36, O-ring 64 preventing water from leaking at the facing surfaces. Radial ribs 116 can be provided on outer surface 84 to improve the user's grip on cap 34.

Tubular extension 98 is dimensioned to matingly receive mounting post 70. A washer 120 is then inserted in extension 98, resting on post 70, and a screw 122 is inserted therethrough to matingly engage interior threads 72 of post 70, thereby rotatably mounting cap 34 on base 36.

One leg 108 is engaged by locking posts 66 when finger 102 closes aperture 58, while the other leg 108 is engaged by locking posts 68 when cap 34 is rotated to open aperture 58. Cap 34 is thereby locked in either the "off" or "on" position until rotated into the contrary position by the user.

Figure 10:
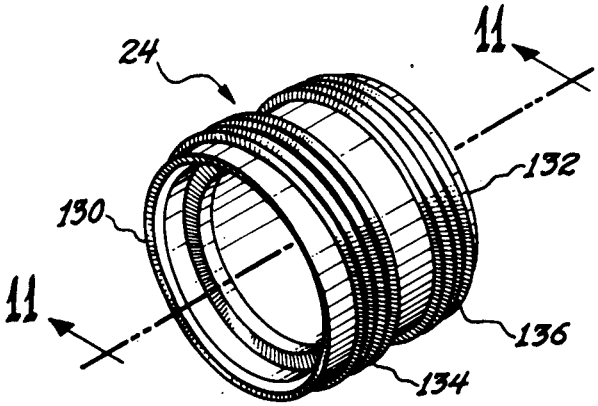
FIG. 10 is a perspective view of a first embodiment of the replacement casing of the water massage apparatus.
Figure 11:
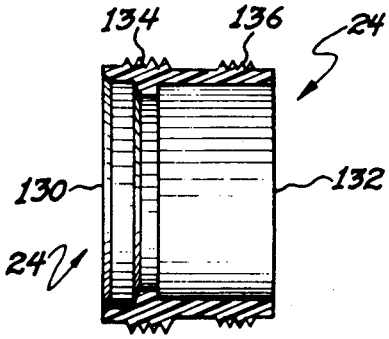
FIG. 11 is a perspective view of the replacement casing of FIG. 10, taken along line 11—11 of FIG. 10.

Referring now to FIGS. 10, 11, and 12, casing 24 in a first embodiment is tubular, having a substantially circular lateral cross-section, and has a receptacle end 130 and an exterior end 132. Receptacle end 130 is provided with a first set of external spiral threads 134 dimensioned to engage the internal spiral threads (such as threads 138) of a water jet receptacle of a portable spa. Exterior end 132 is provided with a second set of external spiral threads 136 for a purpose to be described hereinafter.

Figure 8:
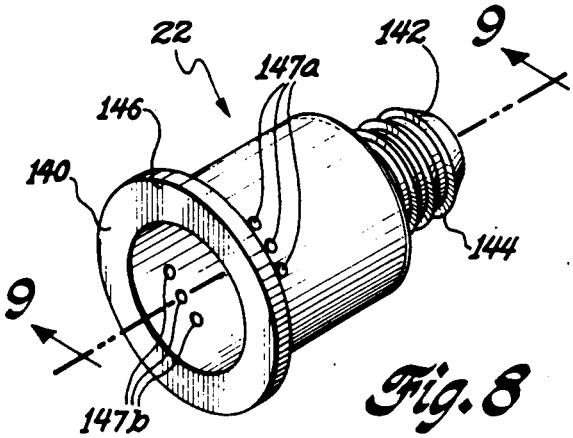
FIG. 8 is a perspective view of a first embodiment of the adapter of the water massage apparatus.
Figure 9:
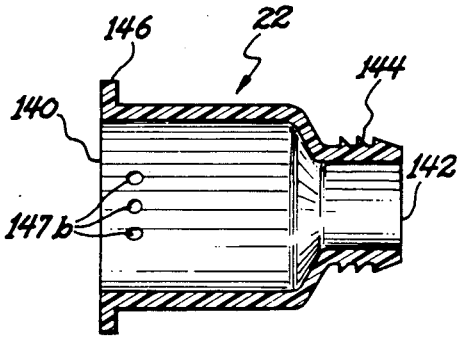
FIG. 9 is a cross-sectional view of the adapter of FIG. 8, taken along line 9—9 of FIG. 8.

Referring now to FIGS. 8, 9, and 12, adapter 22 in a first embodiment is tubular, having a substantially Y-shaped axial cross-section, and has wide end 140 and a narrow end 142. Narrow end 142 is provided with external annular threads or barbs 144 dimensioned to selectively engage end 30 of tubing 26. Wide end 140 is provided with an external flange 146 dimensioned to abut and register with exterior end 132 of casing 24, and two opposed sets **147*a* and 147*b* of holes positioned circumferentially and set in from flange 146. Sets 147*a* and 147*b* consist of three circular holes each and can be positioned at any point of the circumference of flange 145** as long as they are opposite one another.

Sets of holes **147*a* and 147*b* are necessary to provide air-entrainment means for the entrainment of air into the water flowing through tubing 26, without which the apparatus will not function properly. Preferably, the holes have a diameter of approximately $\frac{1}{8}$ inch (0.32 cm.) and are set in from flange 146 by a sufficient distance to allow entry of air into the tube 26 when adapter 22 is connected to casing 24 as discussed below, approximately 7/32 inch (0.56 cm.). Narrow end 142 has an inner diameter of approximately $\frac{7}{8}$ inch (2.22 cm.) to match the inner diameter of inlet port 60**.

Also, if a conventional pool or garden hose is used, narrow end 42 of adapter 22 can be provided with external threads for engagement of the other end of the hose.

Referring now to FIG. 12, connector 25 is tubular and is provided with internal threads 148 to selectively engage external threads 136 of casing 24 and an internal flange 150 to engage flange 146 of adapter 22.

In a preferred embodiment, adapter 22, casing 24, cap 34, and base 36 are made from injection-molded ABS plastic. Connector 25 is a commercially available standard bushing, for example, the cap which is normally used to cover the casing of an in-ground spa. The width of side walls 40 and 80 and upper and lower walls 90 and 50 are generally 0.090 inch. The outer height of cap 34 (excluding finger 102) is 1.04 inches and the outer height of base 36 is 1.30 inches. Upper rim 46 of base 36 and flange 110 of top 34 have an outer diameter of 3.30 inches. Bottom rim 86 of cap 34 has an outer diameter of 3.12 inches (substantially equal to the inner diameter of bottom rim 86 of base 36).

In order to use apparatus 10 in a portable spa with adapter 22 and casing 24, the original casing surrounding the water jet is unscrewed from receptacle 16 in wall 14. Receptacle end 130 of casing 24 is then placed over the proximal end of the water jet and inserted into the spa wall 14 so that external threads 134 engage internal threads 138. External threads 136 will then extend out of wall 14. Next, wide end 140 of adapter 22 is placed with flange 146 abutting exterior end 132 of casing 24 and connector 25 is placed over adapter 22 so that internal threads 148 engage external threads 136 of casing 24 and internal flange 150 engages external flange 146 of adapter 22, thereby establishing a watertight connection between adapter 22 and casing 24. End 30 of tubing 26 can then be force fit onto barbed end 142 of adapter 22. Finally, barbed inlet port 60 is force fit into the other end 28 of tubing 26. Head 20 can then be held by the user and cap 34 rotated to the "on" position to provide a water massage to any part of the body, as shown in FIG. 1. When the use of apparatus 10 is no longer desired, cap 34 can be rotated to the "off" position.

In order to use apparatus 10 in a pool spa or an in-ground spa, only adapter 22 and connector 25 are used. Adapter 22 is placed with flange 146 abutting the exterior end of the original casing and connector 25 is placed over adapter 22 so that internal threads 148 engage the external threads of the original casing. End 30 of tubing 26 can then be force fit onto barbed end 142 of adapter 22. Finally, barbed inlet port 60 is force fit into the other end 28 of tubing 26 and the user can proceed to use head 20 as previously described.

Figure 15:
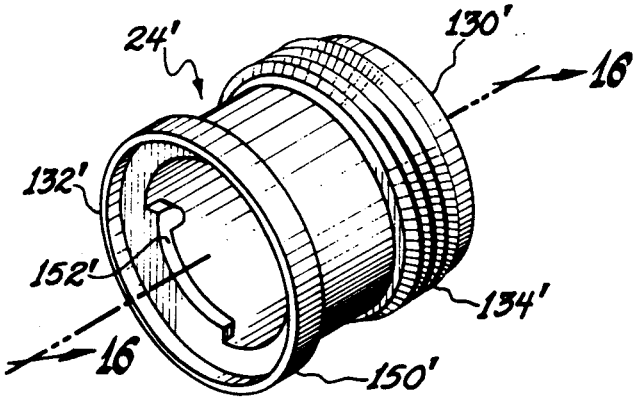
FIG. 15 is a perspective view of a second embodiment of the replacement casing of the water massage apparatus.
Figure 16:
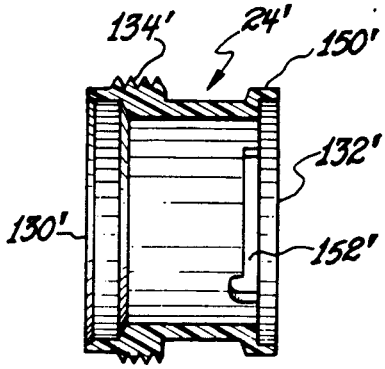
FIG. 16 is a perspective view of the casing of FIG. 15, taken along line 16—16 of FIG. 16.
Figure 17:
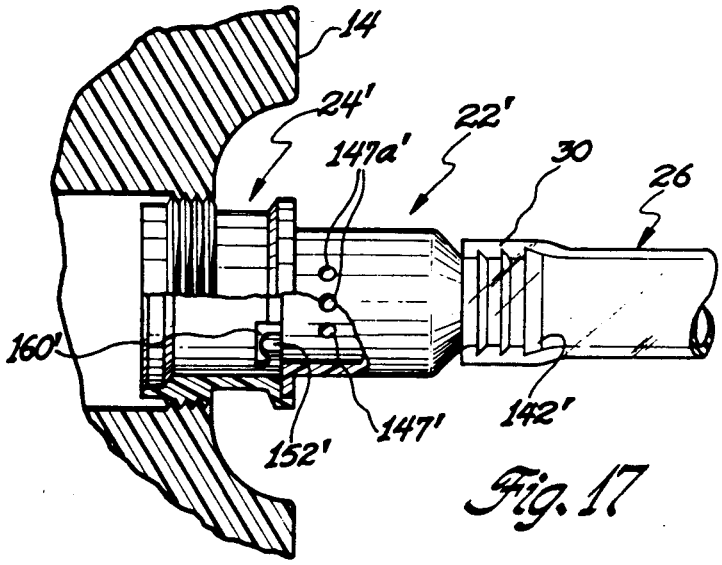
FIG. 17 is a top plan view with parts broken away of the water massage apparatus of the invention installed in a water jet receptacle of the spa shown in FIG. 1, using the adapter and casing of FIGS. 13 and 15.

Referring now to FIGS. 15, 16 and 17, casing 24' in a second embodiment is tubular, having a substantially circular lateral cross-section, and has a receptacle end 130' and an exterior end 132'. Receptacle end 130' is identical to end 130 of casing 24 and is provided with a first set of external threads 134' dimensioned to engage the internal threads (such as threads 16) of a water jet receptacle of a portable spa. Exterior end 132' is provided with an external flange 150' and a pair of opposed interior circumferential ribs 152' for a purpose to be described hereinafter.

Figure 13:
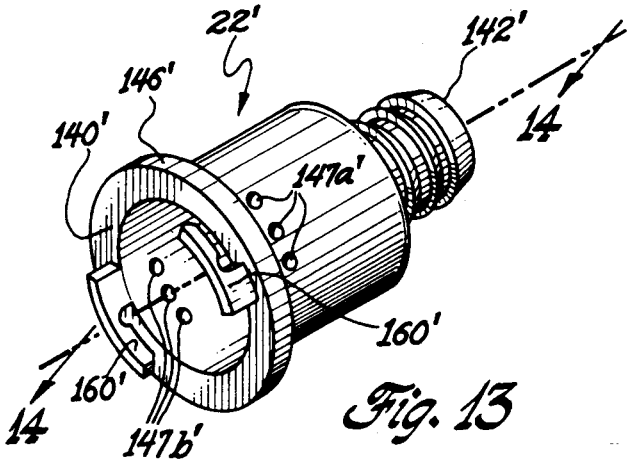
FIG. 13 is a perspective view of a second embodiment of the adapter of the water massage apparatus.
Figure 14:
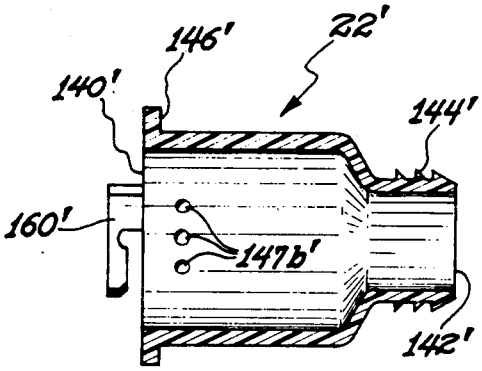
FIG. 14 is a cross-sectional view of the adapter of FIG. 13, taken along line 14—14 of FIG. 13.

Referring now to FIGS. 13, 14, and 17, adapter 22' in a second embodiment is similar to adapter 22, having a wide end 140' and a narrow end 142'. Narrow end 142' is identical to end 142 of adapter 22 and is provided with external barbs 144' dimensioned to selectively engage an end 30 of tubing 26. Wide end 140' is similar to end 140 of adapter 22, being provided with an external flange 146' and two opposed sets **147*a*' and 147*b*' of holes positioned over flange 146' identical to sets 147*a* and 147*b* of holes in adapter 22. However, flange 146' is adapted to be received within exterior flange 150' of bushing 24', and the bottom of flange 146' is provided with opposed bayonets 160' which provide a bayonet joint means for engaging ribs 152' of bushing 24', so as to provide a watertight connection between adapter 22' and bushing 24'** using integral connecting members.

Adapter 22' and bushing 24' are also preferably made from injection-molded ABS plastic, and narrow end 142' of adapter 22' has an inner diameter of ⅞ inch (2.22 cm.).

In order to use apparatus 10' in a portable spa adapter 22' and casing 24', the original casing surrounding the water jet is unscrewed from receptacle 16 in wall 14. Receptacle end 130' of casing 24' is then placed over proximal end of the water jet and inserted into the spa wall 14 so that external threads 134' engage internal threads 138. External threads 136' will then extend out of wall 14. Next, wide end 140' of adapter 22' is placed with flange 146' received in exterior flange 150' of casing 24' and rotated so that bayonets 160' engage ribs 152', thereby establishing a water-tight connection between adapter 22' and bushing 24'. End 30 of tubing 26 can then be force fit over barbed end 142' of adapter 22'. Finally, barbed inlet port 60' is force fit into the other end 28 of tubing 26.

In order to use apparatus 10' in a pool spa or an in-ground spa, only adapter 22' and connector 25 are used. Adapter 22' is placed with flange 146' abutting the exterior end of the original casing and bayonets 160' received inside the original casing. Adapter 24' is then connected to the original casing using connector 25 as previously described with respect to adapter 22. End 30 of tubing 26 can then be force fit over barbed end 142' of adapter 22'. Finally, barbed inlet port 60' is force fit into the other end 28 of tubing 26 and the user can proceed to use head 20 as previously described.

Thus, it will be seen that the disclosed embodiments of the present invention provides a unique water massage apparatus for use in a pool or spa or the like. Moreover, the installation and operation of the apparatus is both effective and easy to accomplish, so as to render the apparatus according to the invention convenient to users. While preferred embodiments of the invention have been disclosed, it should be understood that the spirit and scope of the invention is to be limited solely by the appended claims, since numerous modifications of the disclosed embodiment will undoubtedly occur to those of skill in the art.

What is claimed is:

1. Water massage apparatus for use with a portable spa, in-ground spa, or pool spa having an interior wall including at least one receptacle into which a water jet having proximal and distal ends can be selectively inserted, said apparatus comprising:

a head including a cap and a base having an inlet port and outlet apertures, said inlet port including first attaching means for selective engagement with one end of a hollow tube;

a hollow adapter dimensioned to register with the receptacle and selectively coupled therewith, said adapter having opposed sets of holes for maintaining entrainment of air in the water flowing therethrough said adapter including second attaching means for selective engagement with the other end of the tube; and, a hollow replacement bushing selectively insertable into the receptacle, said bushing being dimensioned to receive the proximal end of the water jet therewithin, and including means mating with said adapter to form a water-tight connection.

2. The apparatus of claim 1, comprising:

said base comprising a side wall having inner and outer surfaces and an upper rim, said side wall having an inlet aperture therethrough and a substantially circular lateral cross-section, an open top defined by said upper rim of said side wall, and a lower wall defining a closed bottom and having inner and outer surfaces; and a mounting post extending upwardly from the center of said inner surface of said bottom and a tubular extension extending downwardly from the center of said cap, said tubular extension matingly receiving at least a portion of said mounting post; and, said cap rotatably attached to said base and comprising a side wall having inner and outer surfaces and a bottom rim, said side wall having a substantially circular lateral cross-section, said bottom rim defining an open bottom and sealingly engaging said upper rim of said base, a top wall defining a closed top and having inner and outer surfaces, said top wall having a plurality of evenly spaced-apart radial apertures therein, and a valve means extending vertically downwardly from said bottom rim for selectively opening and closing said inlet aperture when said cap is rotated on said base, the lateral cross-section of said inlet aperture being approximately the same as the sum of the lateral cross-sections of said outlet apertures.

3. The apparatus of claim 2, said inlet port extending outwardly from said outer surface of said side wall at said inlet aperture, and said inlet port including said first attachment means.

4. The apparatus of claim 3, said first attachment means comprising annular barbs formed on the exterior of said inlet port.

5. The apparatus of claim 2, said inner surface of said top wall being substantially frusto-conical.

6. The apparatus of claim 2, said valve means comprising a finger extending vertically downwardly from said bottom rim and having inner and outer surfaces, said inner surface of said finger being coextensive with said inner surface of said side wall of said cap and said outer surface of said finger sealingly engaging said inner surface of said side wall of said base, and said finger being dimensioned to cover said inlet aperture.

7. The apparatus of claim 2, said cap further including a flange extending outwardly from said outer surface of said side wall of said cap offset from said lower rim of said cap, said flange having upper and lower surfaces, said lower surface of said flange registering with said lower rim of said base.

8. The apparatus of claim 7, said cuter surface of said side wall of said cap sealingly engaging said inner surface of said side wall of said base.

9. The apparatus of claim 2, said base including locking means for selectively locking said valve means in a closed position closing said inlet aperture and in an open position opening said inlet aperture.

10. The apparatus of claim 1, said adapter and said receptable being sealingly connected by hollow connector means.

11. The apparatus of claim 1, said adapter including integral bayonet joint means for connecting said adapter to said bushing.

* * * * *